US011700919B2

(12) United States Patent
Kitano et al.

(10) Patent No.: US 11,700,919 B2
(45) Date of Patent: Jul. 18, 2023

(54) BUTTON ATTACHMENT TOOL

(71) Applicant: YKK CORPORATION, Tokyo (JP)

(72) Inventors: Katsushi Kitano, Tokyo (JP); Ryohei Nakawatase, Tokyo (JP); Yusuke Saito, Tokyo (JP); Jun Obuchi, Tokyo (JP)

(73) Assignee: YKK CORPORATION, Tokyo (JP)

( * ) Notice: Subject to any disclaimer, the term of this patent is extended or adjusted under 35 U.S.C. 154(b) by 0 days.

(21) Appl. No.: 17/778,861

(22) PCT Filed: Dec. 13, 2019

(86) PCT No.: PCT/JP2019/049041
§ 371 (c)(1),
(2) Date: May 23, 2022

(87) PCT Pub. No.: WO2021/117241
PCT Pub. Date: Jun. 17, 2021

(65) Prior Publication Data

US 2022/0408885 A1 Dec. 29, 2022

(51) Int. Cl.
*A44B 17/00* (2006.01)

(52) U.S. Cl.
CPC ..... *A44B 17/0005* (2013.01)

(58) Field of Classification Search
CPC ..... A44B 17/0005; A44B 17/007; A44B 17/0041
See application file for complete search history.

(56) References Cited

U.S. PATENT DOCUMENTS

| | | | | |
|---|---|---|---|---|
| 2006/0048345 | A1* | 3/2006 | Hasegawa | A44B 17/0005 24/104 |
| 2017/0347756 | A1* | 12/2017 | Chen | A44B 17/0082 |
| 2018/0271227 | A1* | 9/2018 | Hayashi | A44B 17/0052 |
| 2019/0116941 | A1* | 4/2019 | Anderson | B63B 17/02 |
| 2019/0328071 | A1* | 10/2019 | Stone | A42B 3/124 |

FOREIGN PATENT DOCUMENTS

| | | |
|---|---|---|
| DE | 19532339 | 3/1997 |
| JP | S553957 | 1/1980 |
| JP | H0243508 | 3/1990 |
| JP | H10304908 | 11/1998 |
| JP | 3383900 | 3/2003 |

OTHER PUBLICATIONS

"International Search Report (Form PCT/ISA/210) of PCT/JP2019/049041," dated Mar. 10, 2020, with English translation thereof, pp. 1-4.

* cited by examiner

*Primary Examiner* — David M Upchurch
(74) *Attorney, Agent, or Firm* — JCIPRNET

(57) ABSTRACT

Provided is a button attachment tool that can eliminate or reduce rotation of a cap relative to an attachment tool body. A button attachment tool comprises a metal attachment tool body and a synthetic resin cap to which the attachment tool body is coupled. The attachment tool body includes a cylindrical part and a flange part extending radially outward from one axial end of the cylindrical part. The flange part includes a plurality of notches recessed radially inward from a peripheral edge of the flange part. The cap includes a clamping part that is fastened to a radially outer portion of the flange part including the plurality of notches.

6 Claims, 5 Drawing Sheets

BUTTON ATTACHMENT TOOL

CROSS-REFERENCE TO RELATED APPLICATION

This application is a 371 application of the International PCT application serial no. PCT/JP2019/049041, filed on Dec. 13, 2019. The entirety of each of the above-mentioned patent applications is hereby incorporated by reference herein and made a part of this specification.

TECHNICAL FIELD

The disclosure relates to a button attachment tool, particularly a button attachment tool for attaching a snap button, a tack button, a type of button or the like that can be put in and out of a button hole to materials of clothes or a bag.

RELATED ART

As a button attachment tool, one in which a metal attachment tool body and a synthetic resin cap are integrally combined is known. Such a button attachment tool is disclosed in, for example, Japanese Patent Laid-open Publication No. 3383900, Japanese Utility Model Laid-open Publication No. H2-43508, and the like. The attachment tool body includes a cylindrical part and a flange part extending outward in the radial direction from one axial end of the cylindrical part. There is an annular protrusion on the back surface of the cap before assembly, and the flange part of the attachment tool body is disposed on the inner side of the annular protrusion in the radial direction. Next, the attachment tool body is connected to the cap by fastening the protruding end side portion of the annular protrusion with respect to the radial outer portion of the flange part so as to plastically deform the annular protrusion inward in the radial direction.

When attaching a button to a material such as clothes, the cylindrical part of the attachment tool body of the button attachment tool is passed through from the back side to the front side of the material, and then the other axial end of the cylindrical part (on the opposite side of the flange part) is fastened to the button.

In a button attachment tool attached to clothes or the like together with a button, the front surface of the cap is often visible to the user on the back side of the clothes or the like. Therefore, a logo, characters, and the like may be attached to the front surface of the cap. However, in the conventional button attachment tool, the connection of the cap to the attachment tool body may be weakened over time, and the cap may rotate with respect to the attachment tool body. In this case, the logo and characters on the front surface of the cap are turned upside down, and the uniformity of the design is impaired. In addition, the rotation of the cap with respect to the attachment tool body may separate the attachment tool body from the cap, or the button may easily come off from the material.

CITATION LIST

Patent Literature

[Patent Literature 1] Japanese Patent Lain-Open No. 3383900

[Patent Literature 2] Japanese Utility Model Laid-open No. H2-43508

SUMMARY

Technical Problem

In view of the above, the disclosure provides a button attachment tool that can eliminate or reduce rotation of a cap with respect to an attachment tool body.

Solution to Problem

To address the above issues, according to an aspect of the disclosure, provided is a button attachment tool including a metal attachment tool body and a synthetic resin cap to which the attachment tool body is connected. The attachment tool body includes a cylindrical part and a flange part extending outward in a radial direction from one axial end of the cylindrical part. The flange part includes multiple notches recessed inward in the radial direction from a peripheral edge of the flange part. The cap includes a clamping part that is fastened to a radial outer portion of the flange part including the multiple notches.

According to the disclosure, the flange part of the attachment tool body is provided with multiple notches recessed inward in the radial direction from the peripheral edge thereof As a result, the clamping part of the cap is fastened to the radial outer portion of the flange part including the multiple notches, so that the clamping part sandwiches the radial outer portion of the flange part with respect to the back surface of the cap, and the resin material of the clamping part enters each notch so as to fill each notch. In this way, rotation of the cap with respect to the attachment tool body can be eliminated or reduced.

In the disclosure, examples of the metal forming the attachment tool body include aluminum, aluminum alloy, copper, copper alloy, nickel, nickel alloy, zinc, zinc alloy, iron, stainless steel and the like, but the disclosure is not limited thereto. Further, examples of the synthetic resin forming the cap include thermoplastic resins such as polyacetal, polyamide, polypropylene, and polybutylene terephthalate, but the disclosure is not limited thereto.

In one embodiment of the disclosure, the multiple notches are formed at intervals at a predetermined angle. For example, when there are three notches, the notches are formed at intervals of 120 degrees in the circumferential direction of the flange part, and when there are five notches, the notches are formed at intervals of 72 degrees in the circumferential direction of the flange part.

In one embodiment of the disclosure, each of the notches intersects the peripheral edge of the flange part at an obtuse angle. Each notch is a part obtained by removing a part of the flange part so as to be recessed inward in the radial direction from the peripheral edge of the flange part, and one notch intersects the peripheral edge of the flange part at two points. By making the two corners where the notch intersects the peripheral edge each be at an obtuse angle, the corners of the notch and the peripheral edge do not damage the corresponding portion of the cap in the long term.

In one embodiment of the disclosure, the cap includes an annular raised part on a back surface facing the flange part of the attachment tool body, and the annular raised part defines an accommodating part on an inner side in the radial direction for receiving the flange part, and the clamping part extends inward in the radial direction from the annular raised part. The cap includes an annular small recess recessed toward the back surface side with respect to a raised side end of the annular raised part on a side of the clamping part opposite to an inner side facing the radial outer portion of the flange part. When connecting the attachment tool body to the cap, first, the flange part of the attachment tool body is disposed in the accommodating part which is the space inside the annular raised part in the radial direction on the back surface of the cap. Next, the clamping part, which was originally an extension portion on the raised side of the annular raised part, is fastened to the radial outer portion of the flange part. As a result, the radial outer portion of the flange part is sandwiched between the back surface of the cap and the clamping part, and the attachment tool body is connected to the cap. Generally, the clamping part is fastened by heat fastening with heating, but by fastening the clamping part by cold working without heating, the manufacturing cost including electricity cost can be further reduced. By such cold working, sufficient resin can be filled into the notches of the flange part, and a small recess is formed at the time of fastening. It can be seen that due to the presence of the small recess, the clamping part firmly sandwiches the radial outer portion of the flange part with the back surface of the cap.

In one embodiment of the disclosure, the cap includes a central raised part that is raised at a center of the back surface. The central raised part allows the base end side of the cylindrical part of the attachment tool body to be supported when the cylindrical part is fastened. When a button is attached to a material using the button attachment tool, the cylindrical part of the attachment tool body is passed through the material, and then the cylindrical part is fastened to the button, and the button is fixed to the material together with the button attachment tool. At the time of fastening the cylindrical part, the central raised part can support the base end side of the cylindrical part, that is, a curved part (to be described later) of the attachment tool body, whereby buckling of the cylindrical part can be prevented. In addition, when the cylindrical part is fastened when the button is being attached to the material, the cap receives the fastening load; therefore, there may be dents left on the front surface of the cap opposite to the back surface, or the logo on the front surface may be crushed. In this embodiment, the central part of the cap becomes thick due to the central raised part provided in the center of the back surface of the cap, and a part of the fastening load that is applied to the cap when the cylindrical part is fastened is received by the thick central raised part; therefore, it becomes possible to avoid or reduce the above-mentioned defects. Further, the base end side of the cylindrical part includes the vicinity of the cylindrical part in the flange part.

In one embodiment of the disclosure, the attachment tool body includes a curved part that connects the cylindrical part and the flange part in a curved shape, and the central raised part is raised to an end of the curved part on the cylindrical part side. The curved part between the cylindrical part and the flange part is the portion where the largest fastening load is applied to the attachment tool body when the cylindrical part is fastened. In this embodiment, the thickness of the central raised part in the axial direction, that is, the height from the back surface of the cap is extended to the end of the curved part of the attachment tool body on the cylindrical part side; therefore, the curved part of the attachment tool body, where the largest load is applied when the cylindrical part is fastened, can be reliably supported by the central raised part, which can prevent buckling of the cylindrical part.

Effects of Invention

In the disclosure, the flange part of the attachment tool body is provided with multiple notches recessed inward in the radial direction from the peripheral edge thereof. As a result, the clamping part of the cap is fastened to the radial outer portion of the flange part including the multiple notches, so that the clamping part sandwiches the radial outer portion of the flange part with respect to the back surface of the cap, and the resin material of the clamping part enters each notch so as to fill each notch. In this way, rotation of the cap with respect to the attachment tool body can be eliminated or reduced.

DESCRIPTION OF THE EMBODIMENTS

Figure 1:
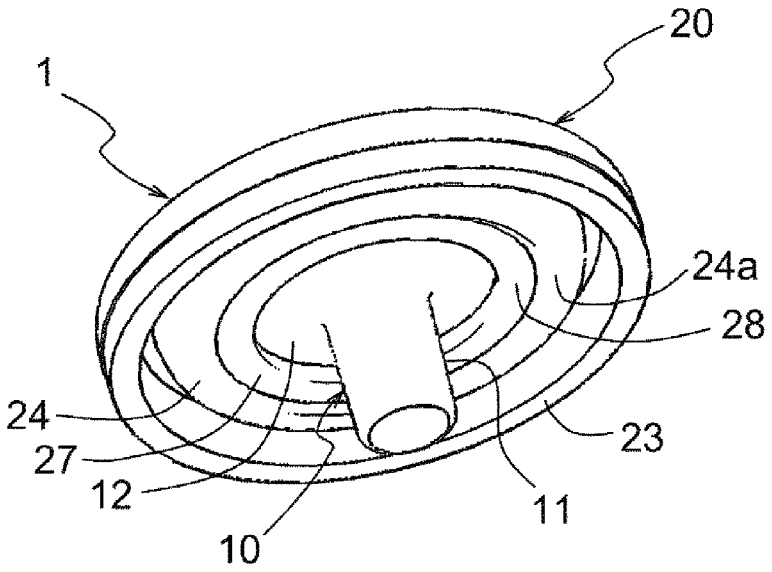
FIG. 1 is a perspective view of a button attachment tool according to an embodiment of the disclosure as viewed from the back side.
Figure 2:
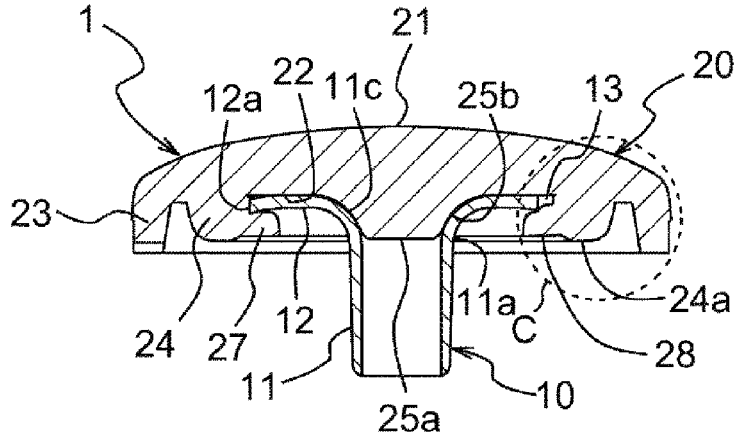
FIG. 2 is a cross-sectional view of the button attachment tool of FIG. 1.
Figure 3:
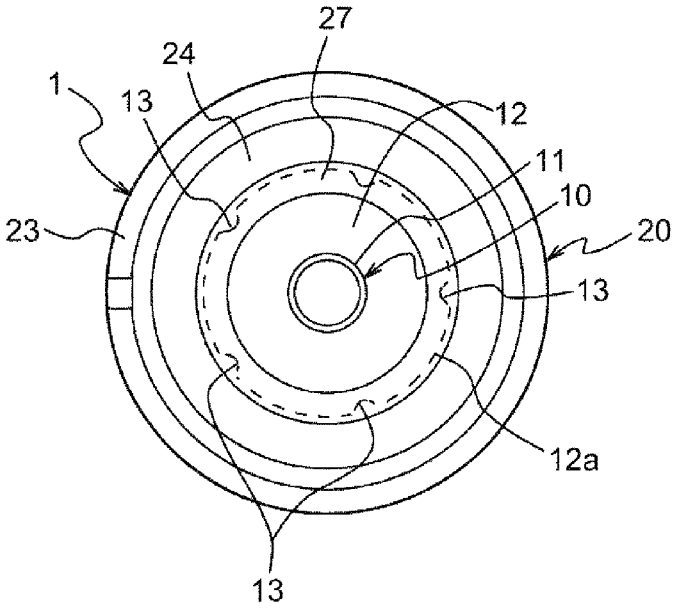
FIG. 3 is a bottom view of the button attachment tool of FIG. 1.
Figure 4:
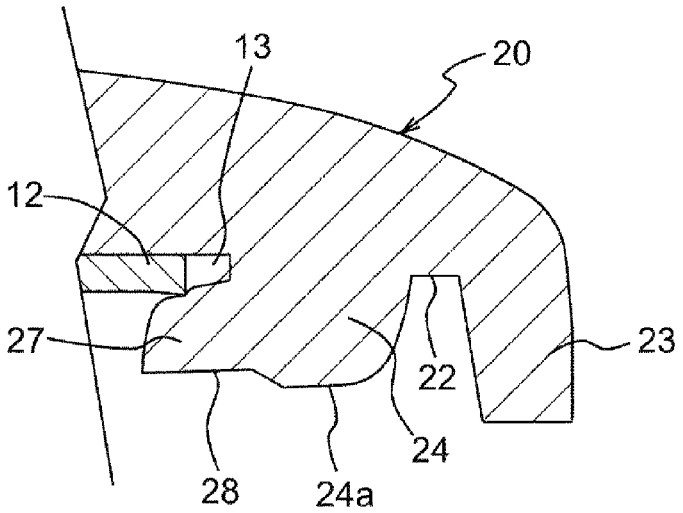
FIG. 4 is an enlarged view of the circled C portion of FIG. 2.
Figure 5:
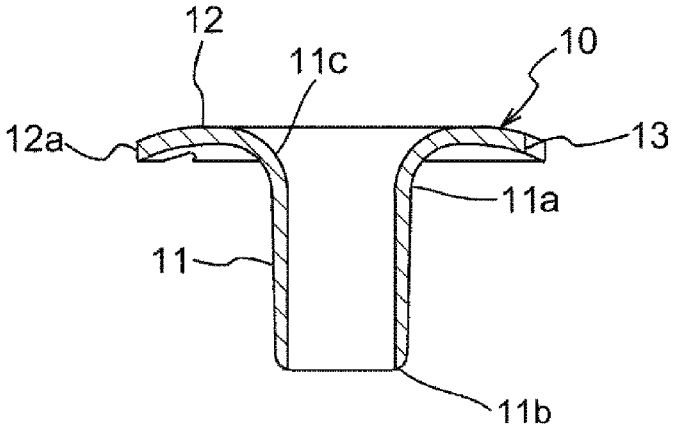
FIG. 5 is a cross-sectional view of the attachment tool body.
Figure 6:
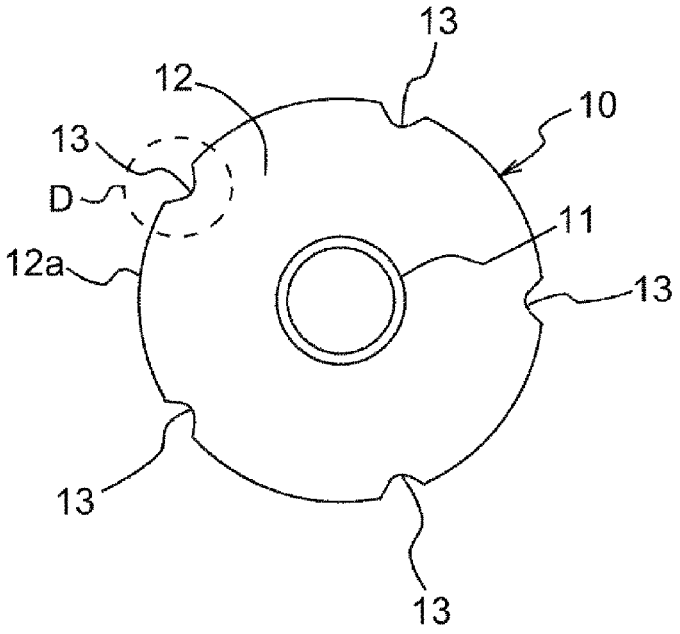
FIG. 6 is a bottom view of the attachment tool body.
Figure 7:
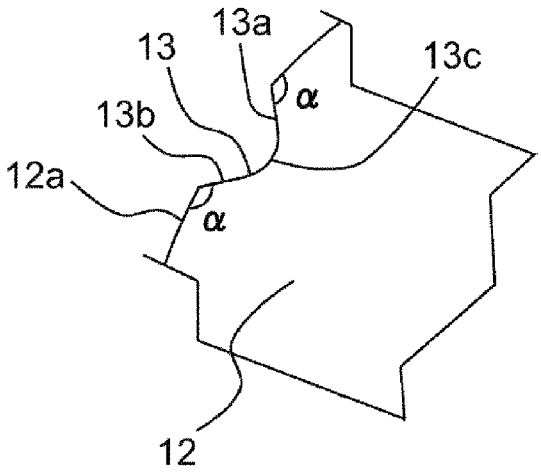
FIG. 7 is an enlarged view of the circled D portion of FIG. 6.
Figure 8:
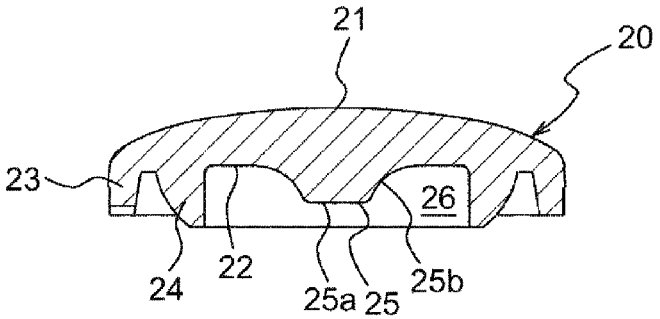
FIG. 8 is a cross-sectional view of the cap before assembly.

Hereinafter, embodiments of the disclosure will be described with reference to the drawings, but the disclosure is not limited to such embodiments. FIG. 1 is a perspective view of a button attachment tool 1 according to an embodiment of the disclosure as viewed from the back side. FIG. 2 is a cross-sectional view of the button attachment tool 1. FIG. 3 is a bottom view of the button attachment tool 1. FIG. 4 is an enlarged view of the circled C portion of FIG. 2. The button attachment tool 1 is configured by integrally combining a metal attachment tool body 10 and a synthetic resin cap 20. FIG. 5 is a cross-sectional view of the attachment tool body 10. FIG. 6 is a bottom view of the attachment tool body 10. FIG. 7 is an enlarged view of the circled D portion of FIG. 6. FIG. 8 is a cross-sectional view of the cap 20 before assembly. In the following description, the up-down direction is based on the pages of FIGS. 2, 5, 8 and the like.

With reference to FIGS. 5, 6 and the like, the attachment tool body 10 includes a cylindrical part 11 and a flange part 12 extending outward in the radial direction from an axial upper end (11*a*) of the cylindrical part 11. In the specification, the axial direction of the cylindrical part 11 is along the up-down direction. Further, in this embodiment, the upper end (base end) of the cylindrical part 11 in the axial direction refers to the position with the reference numeral 11*a* in FIG. 5, which is for convenience of description. The attachment tool body 10 includes a curved part 11*c* that connects the cylindrical part 11 and the flange part 12 in a curved shape. The upper end 11*a* of the cylindrical part 11 is also an end of the curved part 11*c* on the cylindrical part 11 side. The curved part 11*c* of the attachment tool body 10 is a portion to which the largest fastening load is applied when the cylindrical part 11 is fastened when the button is attached using the attachment tool body 10. The upper end 11*a* and the lower end 11*b* of the cylindrical part 11 are open to the outside. In this embodiment, the cylindrical part 11 is a cylinder having substantially constant inner and outer diameters. The inner and outer diameters of the curved part 11*c* gradually expand outward and upward in the radial direction from the upper end 11*a* of the cylindrical part 11 and are gently connected to the flange part 12. The thickness of the cylindrical part 11 along the radial direction becomes slightly thinner toward the lower end 11*b*. The radial outer half of the flange 12 descends slightly downward toward the radial outer end. Therefore, the cross sections of the curved part 11*c* and the flange part 12 are slightly curved to be slightly convex upward.

With reference to FIG. 6, the flange part 12 of the attachment tool body 10 has multiple notches 13 recessed inward in the radial direction from a circular peripheral edge 12*a* which is the outer end in the radial direction. In this embodiment, the flange part 12 is provided with five notches 13 at intervals of 72 degrees. The number of notches 13 may be at least two and may be six or more. However, an embodiment in which a large number of notches 13 are continuously provided on the peripheral edge 12*a* of the flange part 12 is not preferable because two notches 13 and 13 adjacent to each other in the circumferential direction are in contact with each other, and an acute-angled portion may be formed between the two notches 13 and 13. Therefore, it is preferable that the two notches 13 and 13 adjacent to each other in the circumferential direction are provided at intervals without contacting each other.

With reference to FIG. 7, which is an enlarged view of the circled D portion of FIG. 6, each notch 13 is defined by two notched sides 13*a* and 13*b* and a connecting side 13*c*. The two notched sides 13*a* and 13*b* intersect the peripheral edge 12*a* at an obtuse angle α, and the connecting side 13*c* gently connects the inner sides of the two notched sides 13*a* and 13*b* in the radial direction with a rounded recess inward in the radial direction. It can be said that the two notched sides 13*a* and 13*b* and the connecting side 13*c* are edges defining the notch 13 in the flange part 12. In this embodiment, the obtuse angle α is about 120 degrees, but the disclosure is not limited thereto. By preventing an acute angle from being formed between the notch 13 and the peripheral edge 12*a*, it is possible to prevent the notch 13 from damaging the resin cap 20 in the long term.

With reference to FIG. 8, the cap 20 has a front surface 21 and a back surface 22. The front surface 21 of the cap 20 becomes the front surface 21 of the button attachment tool 1 after assembly (see FIG. 2 and the like). On the back surface 22 side of the cap 20, provided are a peripheral side part 23 extending downward at the radial outer end part, an annular raised part 24 protruding downward from the back surface 22 in an annular shape on the inner side in the radial direction of the peripheral side part 23, and a central raised part 25 that is raised downward from the back surface 22 at the center of the back surface 22. As will be described later, the lower end part of the annular raised part 24 is fastened to the flange part 12 when combined with the attachment tool body 10 to become a clamping part 27 (see FIG. 2 and the like). The lower end of the annular raised part 24 before fastening protrudes below the lower end of the peripheral side part 23. The lower end of the peripheral side part 23 is located below the lower end (horizontal plane 25*a*) of the central raised part 25. An accommodating part 26, which is a space for disposing the flange part 12 of the attachment tool body 10, is defined on the back surface 22 of the cap 20 and on an inner side of the annular raised part 24 in the radial direction. The inner diameter of the annular raised part 24 is set to be equal to or slightly greater than the outer diameter of the flange part 12. The outer diameter of the annular raised part 24 gradually decreases from the upper end (base end) along the back surface 22 to the lower end. Therefore, the thickness of the annular raised part 24 along the radial direction gradually decreases from the upper end to the lower end.

Figure 10:
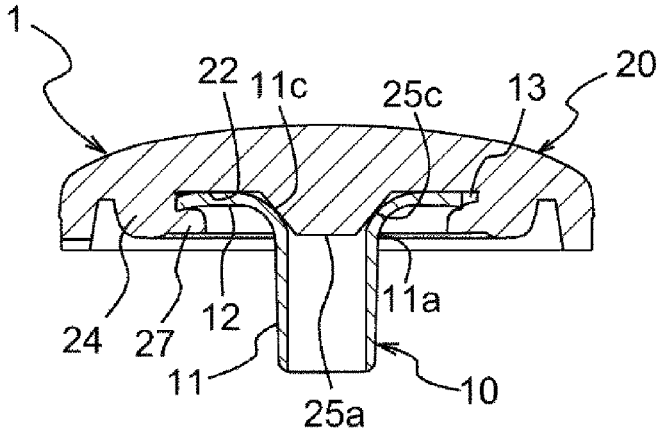
FIG. 10 is a cross-sectional view similar to FIG. 2 showing a modified example of the central raised part.

The central raised part 25 includes a central horizontal plane 25*a* perpendicular to the axial direction, which is the lower end surface, and a curved part support surface 25*b* that is gently connected to the back surface 22 while gradually expanding the outer diameter from the radial outer end of the horizontal plane 25*a*. The position of the horizontal plane 25*a* in the up-down direction is the same as the upper end 11*a* of the cylindrical part 11 of the attachment tool body 10. In this embodiment, the curved part support surface 25*b* is curved so as to substantially match the curved part 11*c* of the attachment tool body 10. More specifically, it is set that R (radius) of the curved part support surface 25*b*≥R of the curved part 11*c* of the attachment tool body 10 so that the degree of curvature of the curved part support surface 25*b* is smaller than that of the curved part 11*c* of the attachment tool body 10. As a result, the curved part 11*c* can be reliably supported by the curved part support surface 25*b* of the central raised part 25 when the cylindrical part 11 is fastened. Further, as shown in FIG. 10 and as will be described later, it can be said that the degree of curvature of the curved part support surface 25*c* that inclines linearly in cross section is smaller than that of the curved part 11*c* of the attachment tool body 10. It can be said that the R of the curved part support surface 25*c* is infinite, and in this specification, it is assumed that R of the curved part support surface 25*c*≥R of the curved part 11*c* of the attachment tool body 10.

When connecting the attachment tool body 10 to the cap 20, first, the flange part 12 of the attachment tool body 10 is disposed in the accommodating part 26 of the cap 20, and then the lower end part of the annular raised part 24 of the cap 20 is fastened to the radial outer part of the flange part 12 including the notches 13. As a result, the lower end part of the annular raised part 24 is plastically deformed inward in the radial direction to become the clamping part 27, and the radial outer end part of the flange part 12 is sandwiched between the back surface 22 of the cap 20. At this time, the resin of the clamping part 27 enters each notch 13 so as to fill each notch 13 of the flange part 12. This makes it possible to eliminate or reduce the situation in which the cap 20 rotates with respect to the attachment tool body 10 over time.

With reference to FIG. 4, which is an enlarged view of the circled C portion of FIG. 2, at the lower end of the clamping part 27 fastened to the flange part 12 of the attachment tool body 10, an annular small recess 28 that is slightly recessed upward with respect to a lower end 24*a* of the annular raised part 24 is formed. In this embodiment, the clamping part 27 of the cap 20 is fastened to the radial outer portion of the flange part 12 of the attachment tool body 10 by cold working without heating. As a result, the manufacturing cost could be reduced as compared with the heat fastening. Further, it can be seen that due to the presence of the small recess 28, the clamping part 27 fastened by cold working firmly sandwiches the radial outer portion of the flange part 12 with the back surface 22 of the cap 20. With reference to FIG. 2, the axial position of the horizontal plane 25*a*, which is the lower end of the central raised part 25, is substantially the same as that of the small recess 28.

Figure 9:
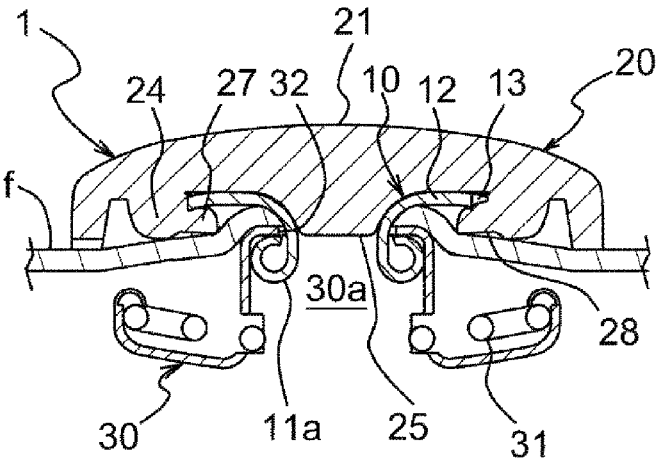
FIG. 9 is a cross-sectional view showing a state in which a button is attached to a material by a button attachment tool.

FIG. 9 is a cross-sectional view showing a state in which a metal female snap button 30, which is an example of a button, is attached to a material f by the button attachment tool 1 described above. The female snap button 30 includes a receiving part 30*a* which is a space for detachably receiving a male snap button (not shown), and a spring 31 which can elastically lock the male snap button received by the receiving part 30*a*. Further, an opening 32 for receiving the cylindrical part 11 of the button attachment tool 1 is provided at the bottom of the receiving part 30*a*. When the female snap button 30 is attached to the material f using the button attachment tool 1, the cylindrical part 11 of the attachment tool body 10 is passed through the material f, and then the cylindrical part 11 is fastened to the female snap button 30 in a curved shape, and the female snap button 30 is fixed to the material f together with the button attachment tool 1. At the time of fastening the cylindrical part 11, the central raised part 25 can support the curved part 11*c* of the attachment tool body 10 on the base end side of the cylindrical part 11. This makes it possible to prevent buckling of the cylindrical part 11. Further, as described above, by setting R (radius) of the curved part support surface 25*b* of the central raised part 25≥R of the curved part 11*c* of the attachment tool body 10, the curved part 11*c* to which the largest fastening load is applied when the cylindrical part 11 is fastened can be reliably supported by the curved part support surface 25*b*. This not only prevents buckling of the cylindrical part 11, but also avoids or reduces defects such as dents left on the front surface 21 of the cap 20 and the logo of the front surface 21 being crushed.

In the above embodiment, an example is given in which the curved part support surface 25*b* of the central raised part 25 of the cap 20 is a curved surface, but the disclosure is not limited thereto. FIG. 10 is a cross-sectional view similar to FIG. 2 showing a modified example of the central raised part 25 of the cap 20. The central raised part 25 in FIG. 10 has a curved part support surface 25*c* whose cross section is inclined linearly. In FIG. 10, since the configuration other than the curved part support surface 25*c* is the same as that of the above-described embodiment, the same reference numerals will be used and the description thereof will be omitted. The curved part support surface 25*c* is connected to the horizontal back surface 22 of the cap 20 while gradually increasing the outer diameter from the radial outer end of the horizontal plane 25*a*. Even with such a curved part support surface 25*c* having a linear cross section, the curved part 11*c* of the attachment tool body 10 can be supported when the cylindrical part 11 is fastened, and buckling of the cylindrical part 11 can be prevented.

What is claimed is:

1. A button attachment tool, comprising:

a metal attachment tool body; and a synthetic resin cap to which the attachment tool body is connected, wherein the attachment tool body comprises a cylindrical part and a flange part extending outward in a radial direction from one axial end of the cylindrical part, the flange part comprises a plurality of notches recessed inward in the radial direction from a peripheral edge of the flange part, and the cap comprises a clamping part that is fastened to a radial outer portion of the flange part comprising the plurality of notches.

2. The button attachment tool according to claim 1, wherein the plurality of notches are formed at intervals at a predetermined angle in a circumferential direction of the flange part.

3. The button attachment tool according to claim 1, wherein each of the notches intersects the peripheral edge of the flange part at an obtuse angle.

4. The button attachment tool according to claim 1, wherein the cap comprises an annular raised part on a back surface facing the flange part of the attachment tool body, the annular raised part defines an accommodating part on an inner side in the radial direction for receiving the flange part, and the clamping part extends inward in the radial direction from the annular raised part, and wherein the cap comprises an annular small recess recessed toward the back surface side with respect to a raised side end of the annular raised part on a side of the clamping part opposite to an inner side facing the radial outer portion of the flange part.

5. The button attachment tool according to claim 1, wherein the cap comprises a central raised part that is raised at a center of a back surface facing the flange part of the attachment tool body.

6. The button attachment tool according to claim 5, wherein the attachment tool body comprises a curved part that connects the cylindrical part and the flange part in a curved shape, and the central raised part is raised to an end of the curved part on the cylindrical part side.

* * * * *